US010086606B2

(12) United States Patent
Shepherd et al.

(10) Patent No.: US 10,086,606 B2
(45) Date of Patent: Oct. 2, 2018

(54) INK MODULATION FOR NOZZLES

(71) Applicant: Hewlett-Packard Development Company, L.P., Houston, TX (US)

(72) Inventors: Matthew A Shepherd, Vacouver, WA (US); Hsue-Yang Liu, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/302,291

(22) PCT Filed: Apr. 8, 2014

(86) PCT No.: PCT/US2014/033251

§ 371 (c)(1),
(2) Date: Oct. 6, 2016

(87) PCT Pub. No.: WO2015/156770

PCT Pub. Date: Oct. 15, 2015

(65) Prior Publication Data

US 2017/0028717 A1 Feb. 2, 2017

(51) Int. Cl.

| | |
|---|---|
| ***B41J 2/045*** | (2006.01) |
| ***B41J 2/155*** | (2006.01) |
| ***B41J 2/21*** | (2006.01) |

(52) U.S. Cl.

CPC ..... *B41J 2/04593* (2013.01); *B41J 2/0451* (2013.01); *B41J 2/0458* (2013.01); *B41J 2/04573* (2013.01); *B41J 2/04586* (2013.01); *B41J 2/155* (2013.01); *B41J 2/2139* (2013.01); *B41J 2/2146* (2013.01)

(58) Field of Classification Search

CPC .... B41J 2/04505; B41J 2/2135; B41J 2/0458; B41J 2/04586; B41J 2/155; B41J 29/393; B41J 2/04573; B41J 2/0451; B41J 2/04593; B41J 2/2139; B41J 2/2146; B41J 2/2132; B41J 2202/20

USPC ..... 347/9, 12–14, 19, 42

See application file for complete search history.

(56) References Cited

U.S. PATENT DOCUMENTS

| | | | |
|---|---|---|---|
| 2002/0039122 | A1 | 4/2002 | Chikuma et al. |
| 2004/0046831 | A1 | 3/2004 | Hempel |
| 2008/0266339 | A1 | 10/2008 | Snyder et al. |

(Continued)

FOREIGN PATENT DOCUMENTS

| | | | |
|---|---|---|---|
| JP | 20100228452 | A | 10/2010 |
| WO | WO-2013050080 | A1 | 4/2013 |

OTHER PUBLICATIONS

Briggs, J.C. et al., Thermal Banding Analysis in Wide Format Inkjet Printing, (Research Paper), Aug. 8, 2000, 5 Pages.

*Primary Examiner* — Jannelle M Lebron
(74) *Attorney, Agent, or Firm* — HP Inc. Patent Department

(57) ABSTRACT

A printer is disclosed. The printer has a print engine that mounts a first printhead and a second printhead adjacent to the first printhead in a staggered line of overlapping printheads. Each printhead has at least one row of nozzles. The blending nozzles in the first printhead overlap with blending nozzles in the second printhead. When printing, the non-overlapping nozzles in the first printhead use a default ink modulation amount and the blending nozzles in both printheads use a scaled ink modulation amount.

20 Claims, 7 Drawing Sheets

(56) References Cited

U.S. PATENT DOCUMENTS

| | | | | |
|---|---|---|---|---|
| 2011/0242213 | A1* | 10/2011 | Okada | B41J 2/155 347/40 |
| 2011/0316911 | A1* | 12/2011 | Ishikawa | G06K 15/107 347/9 |
| 2012/0026227 | A1 | 2/2012 | Tanaka et al. | |
| 2012/0212534 | A1* | 8/2012 | Tanase | B41J 2/155 347/15 |
| 2012/0313989 | A1 | 12/2012 | Mantell et al. | |
| 2013/0215199 | A1 | 8/2013 | Silverbrook et al. | |
| 2014/0028748 | A1 | 1/2014 | Hudd et al. | |

* cited by examiner

INK MODULATION FOR NOZZLES

BACKGROUND

Inkjet printers are printers that traditionally sweep a carriage back and forth across the media as printheads mounted M the carriage deposited printing fluids onto the media. The media is advanced after each swath of the image is printed onto the media. After all the swaths are printed the media is ejected from the printer. Printing fluid is any fluid deposited onto media to create an image, for example a pre-conditioner, gloss, a curing agent, colored inks, grey ink, black ink, metallic ink and the like.

Newer inkjet printers have a page wide array (PWA) of printheads that stretch across the full width of the media. The media is moved underneath the stationary printheads while the printheads deposit printing fluids across the full width of the media.

DETAILED DESCRIPTION

Figure 1:
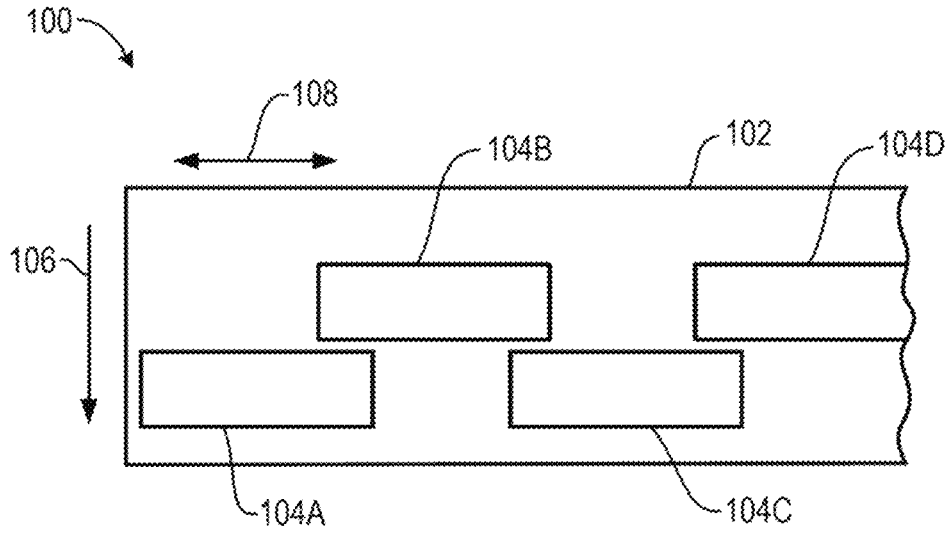
FIG. 1 is a partial bottom view of an example print engine 100.

A page wide array (PWA) of printheads use multiple printheads in an staggered line of overlapping printheads that stretch across the width of the media. FIG. 1 is a partial bottom view of an example print engine 100. Print engine 100 comprises a plurality of printheads (104A-104D) arranged in a staggered line of overlapping printheads along a nozzle axis 108. Each printhead is typically fabricated on one die. When used in a PWA, the printheads (104A-104D) are mounted on a printbar 102 that stretches across the full width of media (not shown). Some large format printers use a smaller number of printheads in a staggered line of overlapping printheads mounted in a carriage that sweeps across the width of the media during printing. A staggered hue of overlapping printheads is defined as two or more printheads that partially overlap any adjacent printheads along a nozzle axis.

Figure 2:
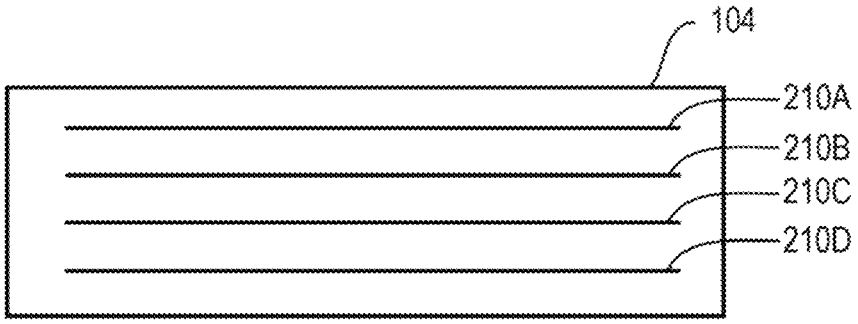
FIG. 2 is a bottom view of an example printhead 104.

Each printhead 104 may have one or more rows of nozzles for each color. FIG. 2 is a bottom view of an example printhead 104. In this example printhead 104 has 4 rows of nozzles (210A-210D), one for each of the following ink colors: cyan, yellow, magenta and black (CYMK). Each row of nozzles may contain up to 1056 nozzles or more. In some examples the nozzles are spaced along the row at 600 nozzles per inch. In other examples the nozzles may be spaced along the row at higher or lower resolutions. In other examples there may be more than one row of nozzles for each color, for example 2 or 4 rows per color. When there are more than one row of nozzles per color, the rows may be offset from each other to increase the printer resolution. For example, when there are 2 rows of nozzles per color the two rows may be offset by half the spacing distance between nozzles. In another example there may be more than 4 colors of ink, 8 for example, with one or more rows of nozzles for each color. The 8 colors may be cyan, light cyan, yellow, light yellow, magenta, light magenta, grey and Black.

Figure 3:
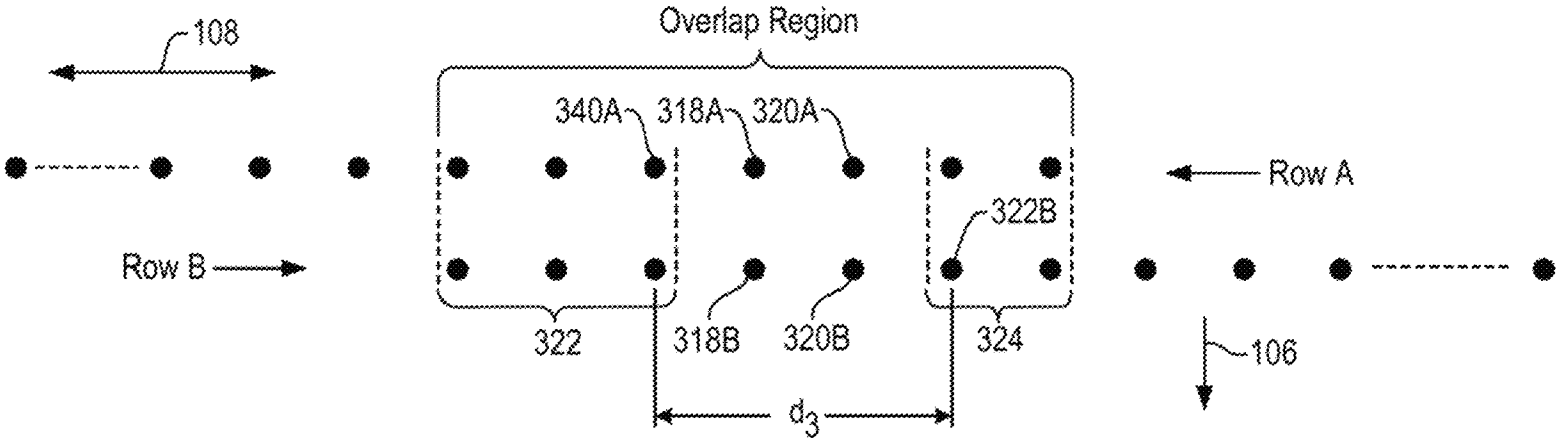
FIG. 3 is an example schematic view of the overlap region for two rows of nozzles.

In a staggered line of overlapping printheads, for example a PWA, each printhead overlaps adjacent printheads by a number of nozzles. FIG. 3 is an example schematic view of the overlap region for two rows of nozzles. FIG. 3 shows a row of nozzles (row A) from a first printhead and a row of nozzles (row B) from a second printhead. The two rows of nozzles are parallel to a nozzle axis shown by arrow 108. The distance between the two rows of nozzles is not to scale and has been reduced for clarity. The nozzles from the two rows of nozzles overlap in the overlap region. In some examples the overlap region may contain 30 nozzles from each row of nozzles plus or minus 2 or 3 nozzles. In other examples there may be more or fewer nozzles in the overlap region. In this example the two rows of nozzles are shown aligned in the nozzle axis (i.e. the nozzles in row A are directly above the nozzles in row B). Because all the rows in each printhead are created on the same die, when the nozzles in one row of a first printhead are aligned with the nozzles in one row of an adjacent printhead, all the nozzles in each row of the first printhead will be aligned with all the nozzles in each row of the adjacent printhead.

When printing an image, the nozzles in the overlap region are used in three different ways. A first set of nozzles on each row are fired at 100% utilization. A second set of nozzles on each row are fired at less than 100% utilization. And a third set of nozzles are not fired (i.e. 0% utilization). In this example, for row A, the nozzles in region 322 are fired at 100% utilization, nozzles 318A and 320A are fired at 50% utilization and the nozzles in region 324 are not used. For row B, the nozzles in region 324 are fired at 100% utilization, nozzles 318B and 320B are fired at 50% utilization and the nozzles in region 322 are not used. The nozzles in each row that are not in the overlap region are fired at 100% utilization. This would include all the nozzles in row A to the left of the overlap region and all the nozzles in row B to the right of the overlap region.

In this example there are two blending nozzles on each row. In other examples there may be more or fewer blending nozzles. A blending nozzle is a nozzle that is used to blend the image between the two overlapping printheads. A blending nozzle is utilized at less than 100%. In this example, the two blending nozzles on each row, nozzles 318A and 320A on row A and nozzles 318B and 320B on row B, are fired at 50% utilization. When a drop of ink for an image needs to be deposited on the media at the location of nozzle 318A along the nozzle axis, either nozzle 318A or nozzle 318B can be used. At 50% utilization, half the time the drop is deposited by nozzle 318A and half the time the drop is deposited by nozzle 318B.

In other examples the blending nozzles on one printhead may have a different utilization than the blending nozzles on the adjacent printhead. The sum of the utilization of the blending nozzles on one printhead plus the utilization of the corresponding blending nozzles on the adjacent printhead will equal 100%. For example, the blending nozzles on one printhead may have an 80% utilization and the blending nozzles on the adjacent printhead may have a utilization of 20%. In some examples the blending nozzles in one row of one printhead may have different utilizations. For example, when there are 4 blending nozzles in each adjacent printhead, the utilization for the 4 blending nozzles in the first printhead may be 20%, 40%, 60% and 80% respectively. The utilization for the 4 corresponding blending nozzles in the adjacent printhead may be 80%, 60%, 40% and 20% respectively.

The nozzle to nozzle spacing is the same for each row of nozzles. Nozzle 340A is the last nozzle in nozzle row A utilized at 100%. Nozzle 322B is the last nozzle on nozzle row B utilized at 100%. The distance between nozzle 340A and nozzle 322B is distance D1 Distance D3 is equal to 3 times the nozzle to nozzle spacing.

Figure 4:
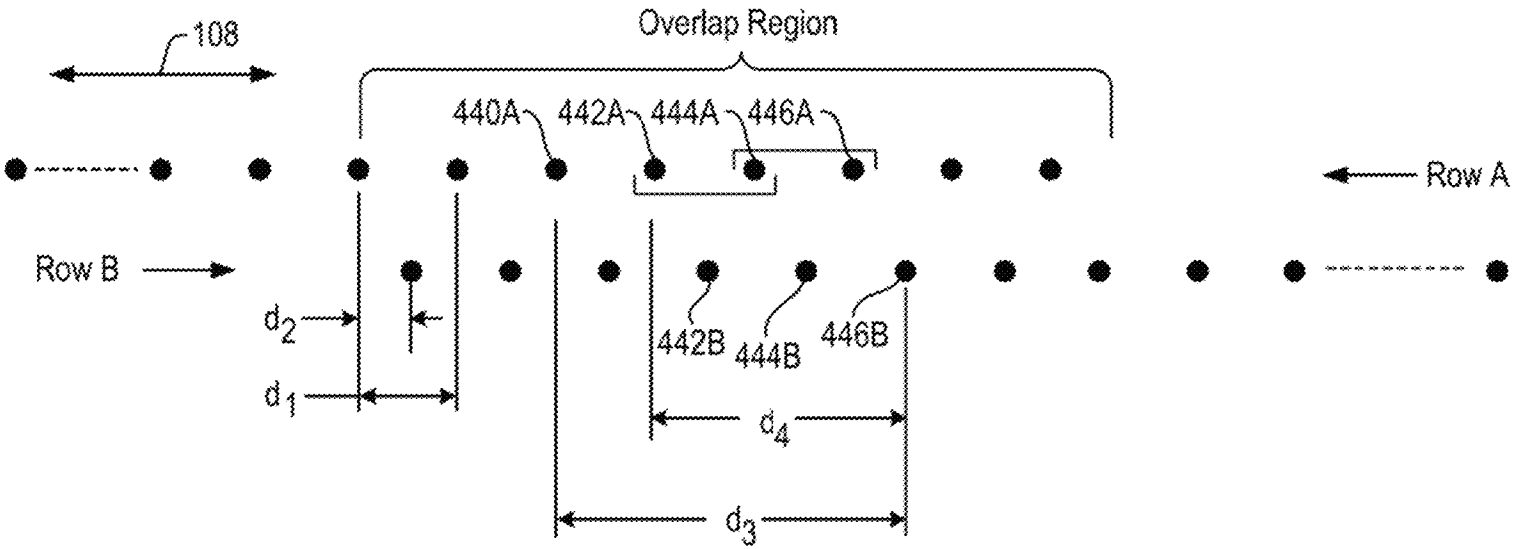
FIG. 4 is another example schematic view of the overlap region for two rows of nozzles.

Due to manufacturing tolerances, the nozzles in one printhead may not be aligned along the nozzle axis with the nozzles in the adjacent printhead. FIG. 4 is another example schematic view of the overlap region for two rows of nozzles. FIG. 4 shows a row of nozzles (row A) from a first printhead and a row of nozzles (row B) from a second printhead. The two rows of nozzles are parallel to a nozzle axis shown by arrow 108. The distance between the two rows of nozzles is not to scale and has been reduced for clarity. The nozzles from the two rows of nozzles overlap in the overlap region. The two rows of nozzles have the same nozzle to nozzle spacing (distance d1). In this example the two rows of nozzles are shown offset in the nozzle axis by distance d2. In this example, the offset is ½ the nozzles to nozzle spacing (i.e. d2=½ d1). In other examples the offset between the two rows of nozzles may be different.

In this example there are two blending nozzles on each row of nozzles. In other examples there may be more or fewer blending nozzles. A blending nozzle is a nozzle that is used to blend the image between the two overlapping printheads. A blending nozzle is utilized at less than 100%. Nozzles 442B and 444B are the two blending nozzles on nozzle row B.

There are two sets of two nozzles on nozzle row A that may be used as the two blending nozzles. Nozzles 442A and 444A make up the first set of nozzles and nozzles 444A and 446A make up the second set of nozzles. When using the first set of nozzles (442A and 444A) in row A as the blending nozzles, nozzle 440A is the last nozzle in nozzle row A utilized at 100%. Nozzle 446B is the last nozzle on nozzle row B utilized at 100%. The distance between nozzle 440A and nozzle 446B is distance D3.

When using the second set of nozzles (444A and 446A) in row A as the blending nozzles, nozzle 442A is the last nozzle in nozzle row A utilized at 100%. The distance between nozzle 442A and nozzle 446B is distance D4. Distance D3 is equal to 3.5 times the nozzle to nozzle spacing. Distance D4 is smaller than distance D3 and is equal to 2.5 times the nozzle to nozzle spacing.

The distance between the last nozzle in row A utilized at 100% and the last nozzle in row B utilized at 100% when the nozzles in the two rows are aligned (see FIG. 3) is 3 times the nozzle to nozzle spacing. When using the first set of nozzles in row A as the blending nozzles when the nozzles between the two rows are not aligned, the distance between the last nozzle in row A utilized at 100% and the last nozzle in row B utilized at 100% is equal to 3.5 times the nozzle to nozzle spacing. This is larger than the nozzle to nozzle spacing when the nozzles are aligned. This creates a lighter area in the image printed by the blending nozzles between the two printheads.

When using the second set of nozzles in row A as the blending nozzles when the nozzles between the two rows are not aligned, the distance between the last nozzle in row A utilized at 100% and the last nozzle in row B utilized at 100% is equal to 7.5 times the nozzle to nozzle spacing. This is smaller than the nozzle to nozzle spacing when the nozzles are aligned. This creates a darker area in the image printed by the blending nozzles between the two printheads.

This defect due to misaligned nozzles along the nozzle axis between the two printheads is known as thin die to die boundary banding (TDBB). Depending on which set of nozzles are selected to be used as the blending nozzles, the image between the two printheads will either be too light or too dark. One way to correct this problem is to make sure the adjacent printheads are physically aligned to each other. Unfortunately, this would increase the cost of the print engine.

In one example, the printer will modulate the ink amount used by the blending nozzles. The ink modulation will be increased when using the first set of nozzles in row A (i.e. when the image printed by the blending nozzles is too light) and the ink modulation will be decreased when using the second set of nozzles on row A (i.e. when the image printed by the blending nozzles is too dark). The amount the ink modulation is scaled will be determined using a calibration routine. The calibration routine will print a target in the overlap region of each set of adjacent printheads. Light or dark streaks in the thin die to die boundary region will be located. The density difference between the light or dark streaks and the average density value of the target will be used to scale the ink modulation of the image printed with the blending nozzles.

In one example a target will be printed with different ink modulation amount used for the blending nozzles. The printed images will be scanned and light or dark streaks will be located in the overlapped region. The difference delta (Δ) between the average printed density of the targets will be compared to the density of the light or dark streaks. The ink modulation amount for the blending nozzles can be determined using A.

Figure 5:
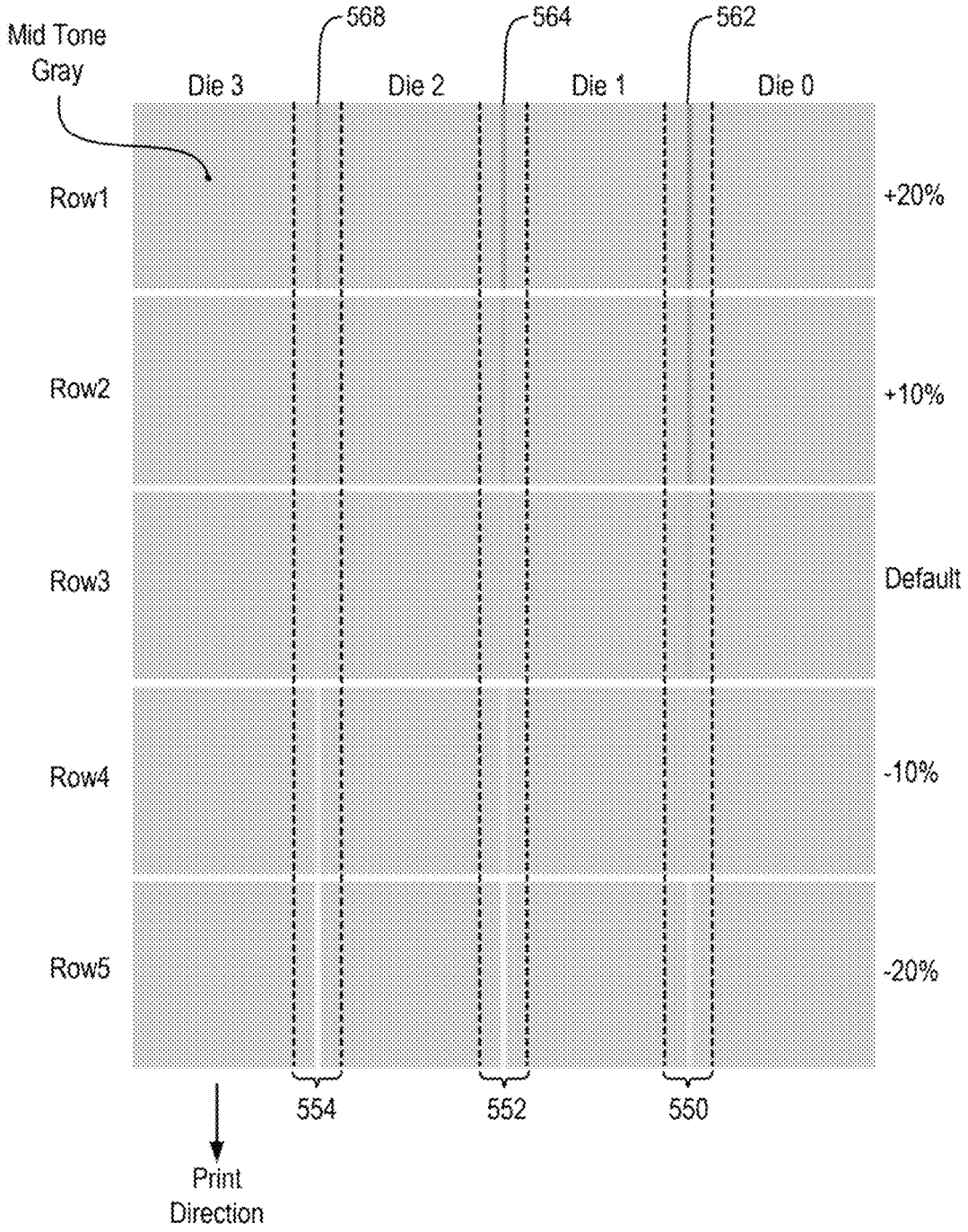
FIG. 5 is an example target printed by a PWA of printheads.

FIG. 5 is an example target printed by a staggered line of overlapping printheads, for example a PWA of printheads. The target is printed by a number of printheads where each printhead is located on its own die. The printheads/dies stretch across the width of the page in a staggered line. The page moves in the printing direction (i.e. down the length of the page) as the target is printed. For clarity the target shown does not stretch across the full width of the page, but in the actual implementation the target would include all the die to die overlap areas on the printbar. In this example 4 dies/printheads are shown (die0-die3).

There is an overlap area between each adjacent set of dies where the nozzles from the first die overlap the nozzles from the adjacent die. The overlap area between die0 and die1 is area 550. The overlap area between die1 and die2 is area 552. The overlap area between die2 and die3 is area 554. In each overlap area there is a portion of the image printed by the blending nozzles in the two adjacent dies. The image printed by the blending nozzles between die0 and die1 is area 562. The image printed by the blending nozzles between die1 and die2 is area 564. The image printed by the blending nozzles between die2 and die3 is area 568.

The image printed by each die is a constant density target, in this example a mid tone grey level. In other examples other colors or densities may be used, for example a 70% magenta target. In this example the target is shown as being printed across the full width of each die/printhead. In other examples the constant density target may only be printed by a small set of the nozzles on each side of the blending nozzles, for example 40 nozzles on each side of the blending nozzles. The number of nozzles in the small set of nozzles will be selected such that an accurate value for the background level of the constant density target can be measured.

Each row (rows 1-5) in the target has a different amount of ink modulation used for the portion of the image printed with the blending nozzles between the adjacent dies/printheads. Row 1 has +20% modulation, row 2 has +10% modulation, row 3 has 0% or the default modulation, row 4 has −10% modulation and row 5 has −20% modulation. When the nozzles from two adjacent dies are aligned, the image area printed by the blending nozzles will be the same density as the constant density image in row 3. This is because the image printed by the blending nozzles in row three use the default modulation used by the rest of the nozzles in each of the dies.

In this example the nozzles in die 1 are aligned with the nozzles in die 2. As can be seen, the image area printed by the blending nozzles between dies 1 and 2 (area 564) in row 3 have the same color/density as the image areas printed adjacent to area 564 (i.e. the surrounding area). Image area 564 is a different intensity than the adjacent printed area in rows 1, 2, 4 and 5. In rows 1 and 2 with a 20% and 10% increase in ink modulation respectively, area 564 is darker than the surrounding area. In rows 4 and 5 with a 10% and 20% decrease in ink modulation respectively, area 564 is lighter than the surrounding area.

The nozzles in die 0 are miss-aligned with the nozzles in die 1. Area 562, printed by the blending nozzles of dies 0 and 1, is darker that the surrounding area in rows 1, 2 and 3. Area 562 is almost the same color/density as the surrounding area in row 4. Area 562 is lighter than the color/density as the surrounding area in row 5. By measuring the density of area 562 and the surrounding area in each row, the difference in density Δ compared to the surrounding area vs. the modulation amount can be determined. The density of the printed target can be measured using a scantier or one or more sensors in the printer. The scanner can be a standalone scanner or may be incorporated with the printer as a multi-functional peripheral (MFP).

Figure 6:
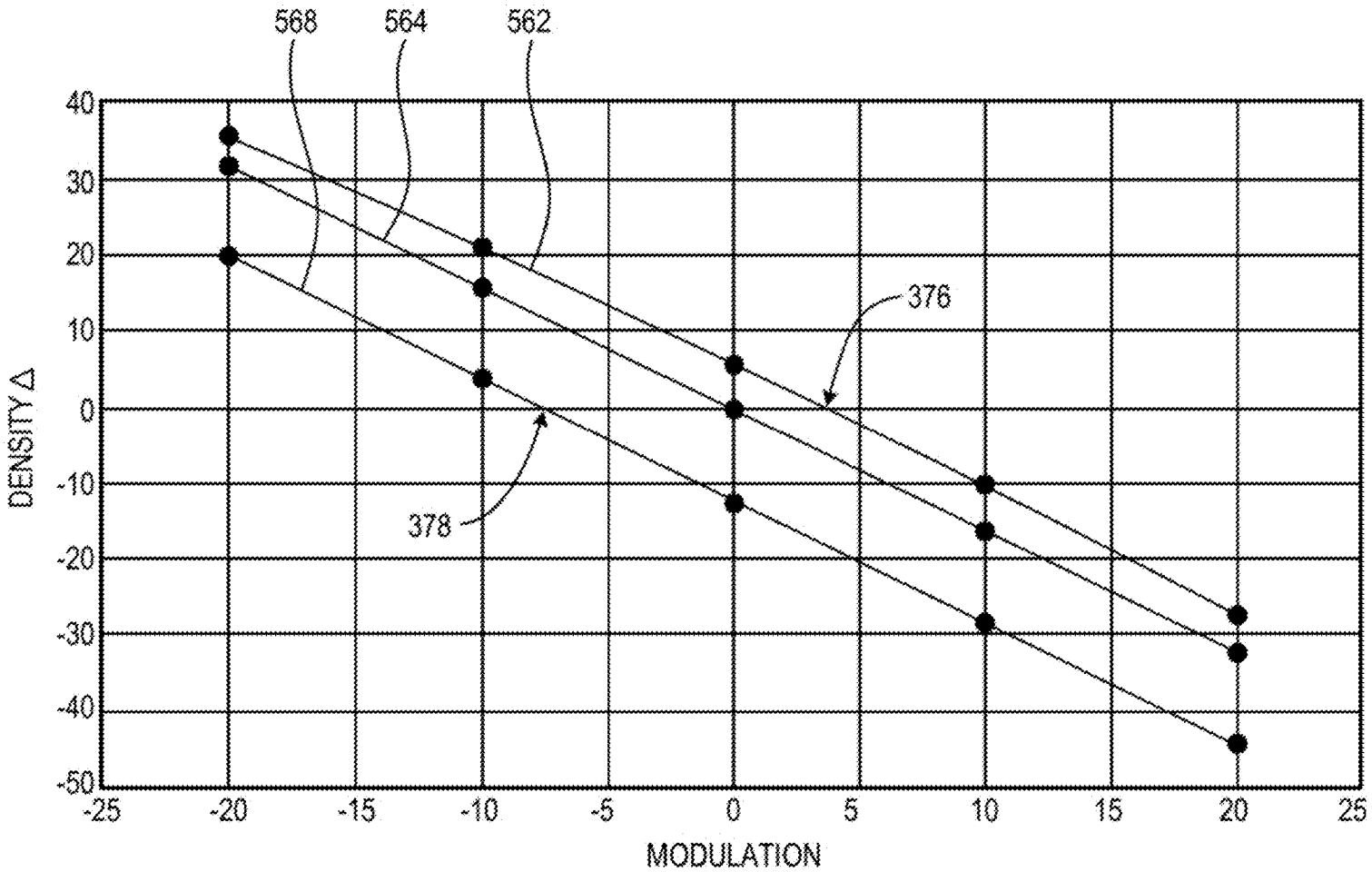
FIG. 6 is an example plot of the difference in the density Δ of the image printed with the blending nozzles and the density of the surrounding area.

The difference Δ vs. the modulation amount can be plotted and the intercept point where the modulation amount causes the density of area 562 to match the density of the surrounding area can be determined (see FIG. 6). The modulation amount that causes the density of area 562 to match the density of the surrounding area may be used to adjust the image printed using the blending nozzles between dies 0 and 1. By using the correct modulation amount, the density of the image printed with the misaligned blending nozzles can be matched to the density of the image printed with the adjacent nozzles. The same calculation can be done for the blending nozzles of each adjacent pair of printheads.

Because all the rows of nozzles on each printhead are created on the same die, the alignment between all the rows on a first printhead will be the same for all the rows on an adjacent printed. Therefore if the target is printed using only one color of ink, for example black, the ink modulation amount calculated for the black ink nozzles between each set of adjacent printheads may be used for all the nozzles for each color for that pair of adjacent printheads. In other examples, an ink modulation amount will be determined for each color in each set of adjacent printheads.

FIG. 6 is an example plot of the difference in the density Δ of the image printed with the blending nozzles and the density of the surrounding area. The horizontal axis is the different amount of ink modulation. The vertical axis is the difference in density Δ. Three lines are plotted with each line corresponding to a set of blending nozzles. The top line represents the image area 562 printed with the blending nozzles of die 0 and 1. The middle line represents the image area 564 printed with the blending nozzles of die 1 and 2. The bottom line represents the image area 568 printed with the blending nozzles of die 2 and 3. Each line has 5 data points representing the 5 rows in the printed target.

The nozzles in dies 1 and 2 are aligned with each other (in the nozzle axis) and the plot of the line 564 intersects the horizontal axis at zero. Therefore the blending nozzles will print the same density as the nozzles on either side without any ink modulation. The nozzles between dies 0 and 1 are not aligned. The plot intersects the horizontal axis at point 376 which is about 3.3% modulation. Therefore during operation the image printed with the blending nozzles for die 0 and 1 will be modulated at 3.3% to produce the same printed image density as the nozzles on either side. The nozzles between dies 2 and 3 are not aligned. The plot intersects the horizontal axis at point 378 which is about −7.5% modulation. Therefore during operation the image printed with the blending nozzles for die 2 and 3 will be modulated at −7.5% to produce the same printed image density as the nozzles on either side.

In one example the modulation amount for each set of adjacent printheads may be entered into the printer by a user during a calibration routine. The user may use the printer's user interface, for example a touch screen, to enter the values. In another example, a scanner integrated with the printer as part of a multi-functional peripheral (MFP) may scan the target and automatically send the modulation amounts to the printer.

The slope of the plotted lines in FIG. 6 are very similar. Using the measured slope and a single data point, the intersection of the line with the horizontal axis can be determined. In one example the target for calibration will only print row zero. Using the density difference Δ between the image printed with the blending nozzles and the surrounding area and the measured slope from a number of previously measured adjacent printheads, the intersection with the horizontal axis can be determined.

The print modulation is a scaling amount for the image printed with the blending nozzles. In one example the scaling can be done for all the ink channels at the same time by scaling the density of the image when the image is in LAB color space. In another example the density for each color channel is scaled separately when the image data is in contone-linear ink space. In one example an image to be printed has the following ink densities in contone-linear ink space: 50%, 50%, 10%, 0% for the cyan, yellow, magenta and black inks respectively. The nozzles on either side of the blending nozzles would print the image using these densities/ink amounts. In this example the blending nozzles are miss-aligned such that a 12% increase in ink modulation is needed to print the image with the same density as the surrounding nozzles. In this case the image data for the blending nozzles would be modified by 12% such that the blending nozzles would print using the following ink densities: 56%, 11.2% and 0%. In one example the ink modulation scaling is done in the data pipeline before the image is halftoned.

Figure 7:
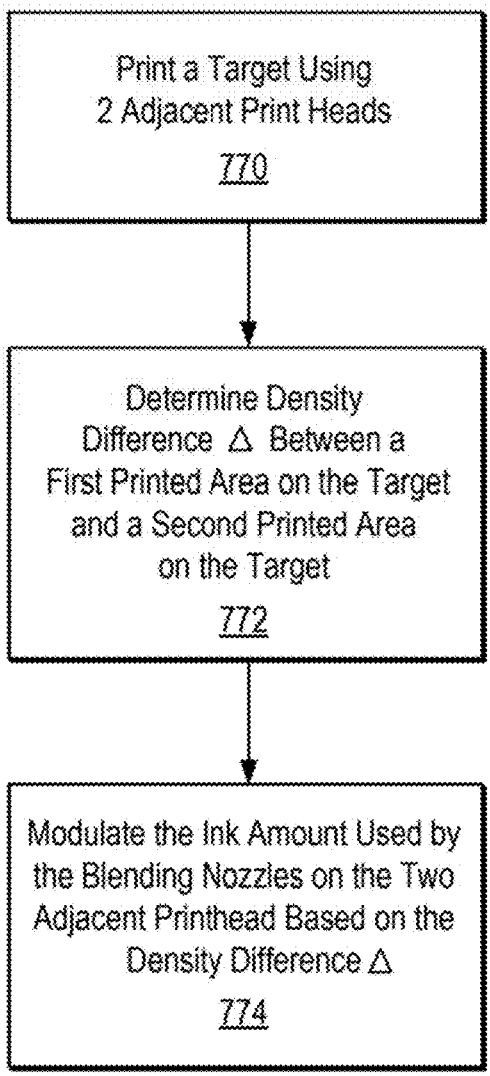
FIG. 7 is an example flow chart for a method of printing.

FIG. 7 is an example flow chart for a method of printing. At 770 a target is printed using two adjacent printheads. At 772 the density difference Δ of a first printed target area and a second printed target area is determined. The first printed target area is printed with blending nozzles in the two adjacent printheads. The second printed target area is the area on either side of the first printed target area. At 774 the ink amount used for printing images with the blending nozzles of the two adjacent printheads is modulated based on the density difference Δ.

Figure 8:
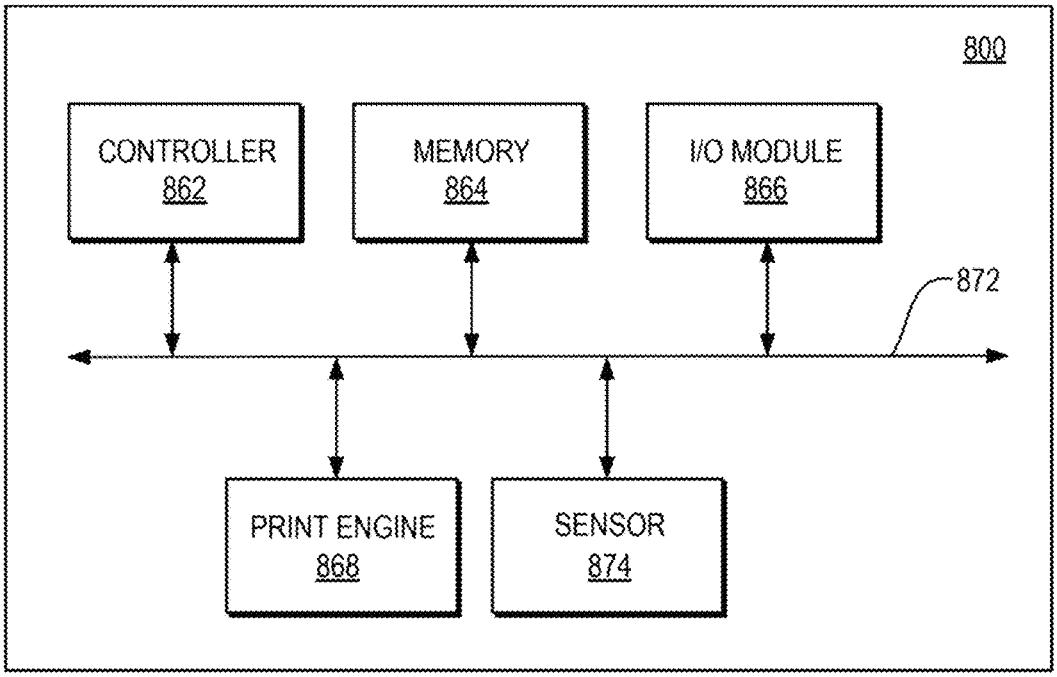
FIG. 8 is an example electrical block diagram of a printer 800.

FIG. 8 is an example electrical block diagram of a printer 800. Printer comprises a controller 862, memory 864, input/output (I/O) module 866, print engine 868 and a sensor 874 all coupled together on bus 872. In some examples printer may also have a user interface module, an input device, and the like, but these items are not shown for clarity. Controller 862 comprises at least one processor. The processor may comprise a central processing unit (CPU), a micro-processor, an application specific integrated circuit (ASIC), or a combination of these devices. Memory 864 may comprise volatile memory, non-volatile memory, and a storage device. Memory 864 is a non-transitory computer readable medium. Examples of non-volatile memory include, but are not limited to, electrically erasable programmable read only memory (EEPROM) and read only memory (ROM). Examples of volatile memory include, but are not limited to, static random access memory (SRAM), and dynamic random access memory (DRAM). Examples of storage devices include, but are not limited to, hard disk drives, compact disc drives, digital versatile disc drives, optical chives, and flash memory devices.

I/O module 866 is used to couple printer to other devices, for example the Internet or a computer. Printer has computer executable code, typically called firmware, stored in the memory 864. The firmware is stored as computer readable instructions in the non-transitory computer readable medium (i.e. the memory 864). The processor generally retrieves and executes the instructions stored in the non-transitory computer-readable medium to operate the printer and to execute functions. In one example, processor executes code that adjusts the ink modulation of blending nozzles in adjacent printheads, for example as shown in FIG. 7.

What is claimed is:

1. A printer, comprising:

a print engine, the print engine comprising a staggered line of overlapping printheads, the staggered line of overlapping printheads including a first printhead and a second printhead, wherein the first printhead partially overlaps the second printhead by a predetermined number of nozzles in an overlap area, and wherein the predetermined number of nozzles in the overlap area of the first printhead includes a first set of nozzles being set to dispense ink at 100% utilization and a second set of nozzles being set to dispense ink at less than 100% utilization; and a controller coupled to the print engine to:

determine a distance between a last nozzle of the first printhead to be utilized at 100% and a last nozzle of the second printhead to be utilized at 100%, in response to a determination that the determined distance is greater than a threshold, increase a utilization setting of the second set of nozzles of the first printhead to increase an amount of ink to be dispensed by the second set of nozzles, and cause the first and second printheads of the print engine to print an image.

2. The printer of claim 1, wherein the predetermined number of nozzles in the overlap area of the first printhead further includes a third set of nozzles being set to not dispense ink, and the predetermined number of nozzles in the overlap area of the second printhead includes a first, a second, and a third set of nozzles, which are respectively aligned with the first, second, and third sets of nozzles in the overlap area of the first printhead, and wherein the controller is to control an amount of ink being dispensed from the second printhead such that the first set of nozzles in the overlap area of the second printhead does not dispense ink, the second set of nozzles in the overlap area of the second printhead dispenses ink at less than 100% utilization, and the third set of nozzles in the overlap area of the second printhead dispenses ink at 100% utilization.

3. The printer of claim 1, wherein the staggered line of overlapping printheads form a page wide array (PWA) of printheads.

4. The printer of claim 1, wherein the first set of nozzles and the second set of nozzles in the overlap area of the first printhead each contain at least 2 nozzles.

5. The printer of claim 1, wherein, in response to the determination that the determined distance is greater than the threshold, the controller is to control the second set of nozzles in the overlap area of the first printhead to dispense ink at more than 50% utilization.

6. The printer of claim 1, wherein one nozzle in the first set of nozzles in the overlap area of the first printhead uses a different utilization than another nozzle in the first set of nozzles.

7. The printer of claim 1, wherein the first printhead and the second printhead each deposit 4 colors of ink onto media, where the first printhead has nozzles for each ink color in the overlap area and the second printhead has nozzles for each ink color in the overlap area.

8. The printer of claim 1, wherein the amount of ink dispensed from the nozzles in the overlapping area of the first and second printheads is determined by printing a target, using both the first printhead and the second printhead, and determining a density difference between a first area on the target printed using the nozzles in the overlap areas of the first printhead and the second printhead and a second area on the target printed using only nozzles in a non-overlap area of the first printhead, where the first target area is adjacent to the second target area.

9. The printer of claim 1, wherein the controller is to:

in response to a determination that the determined distance is less than the threshold, decrease the utilization setting of the second set of nozzles of the first printhead to decrease the amount of ink to be dispensed by the second set of nozzles.

10. The printer of claim 1, wherein the controller is to:

determine whether the nozzles of the first printhead are aligned with the nozzles of the second printhead, and in response to a determination that the nozzles of the first printhead are misaligned with the nozzles of the second printhead, determine the distance between the last nozzle of the first printhead to be utilized at 100% and the last nozzle of the second printhead to be utilized at 100%.

11. A method of printing, comprising:

arranging, in a printer, a first printhead partially overlapping a second printhead by a predetermined number of nozzles in an overlap area, the predetermined number of nozzles in the overlap area of the first printhead includes a first set of nozzles being set to dispense ink at 100% utilization and a second set of nozzles being set to dispense ink at less than 100% utilization;

determining, by a processor of the printer, a distance between a last nozzle of the first printhead to be utilized at 100% and a last nozzle of the second printhead to be utilized at 100%;

in response to a determination that the determined distance is greater than a threshold, increasing, by the processor, a utilization setting of the second set of nozzles of the first printhead to increase an amount of ink to be dispensed by the second set of nozzles; and printing, by the printer, a target using the first and second printheads.

12. The method of claim 11, further comprising:

in response to a determination that the determined distance is less than the threshold, decreasing, by the processor, the utilization setting of the second set of nozzles of the first printhead to decrease the amount of ink to be dispensed by the second set of nozzles.

13. The method of claim 11, further comprising:

determining whether the nozzles of the first printhead are aligned with the nozzles of the second printhead; and in response to a determination that the nozzles of the first printhead are misaligned with the nozzles of the second printhead, determining the distance between the last nozzle of the first printhead to be utilized at 100% and the last nozzle of the second printhead to be utilized at 100%.

14. The method of claim 11, wherein the overlap area of the second printhead includes a first set of nozzles being set at 100% utilization and a second set of nozzles being set at less than 100% utilization, and wherein the method further comprises:

in response to the determination that the determined distance is less than the threshold, decreasing the utilization setting of the second set of nozzles of the second printhead to decrease the amount of ink to be dispensed by the second set of nozzles.

15. The method of claim 11, further comprising:

determining a density difference between a first area on a target printed using the nozzles in the overlap area of the first and second printheads and a second area on the target printed using only nozzles in a non-overlap area of the first printhead, wherein the first target area is adjacent to the second target area, and wherein both the first area of the target and the second area of the target are printed using a default modulation amount.

16. The method of claim 11, wherein increasing the utilization setting of the second set of nozzles in the overlap area of the first print head such that the second set of nozzles is to dispense ink at more than 50% utilization.

17. A printer, comprising:

a print engine comprising a first printhead partially overlapping a second printhead by a predetermined number of nozzles in an overlap area, wherein the predetermined number of nozzles in the overlap area of the first printhead includes a first set of nozzles being set to dispense ink at 100% utilization and a second set of nozzles being set to dispense ink at less than 100% utilization;

a processor; and a memory storing instructions that when executed by the processor cause the processor to:

determine a distance between a last nozzle of the first printhead to be utilized at 100% and a last nozzle of the second printhead to be utilized at 100%, in response to a determination that the determined distance is greater than a threshold, increase a utilization setting of the second set of nozzles of the first printhead to increase an amount of ink to be dispensed by the second set of nozzles, and cause the first and second printheads of the print engine to print an image.

18. The printer of claim 17, wherein the processor is to increase the utilization setting of the second set of nozzles in the overlap area of the first printhead such that the second set of nozzles is to dispense ink at more than 50% utilization.

19. The printer of claim 17, wherein the instructions are to cause the processor to:

in response to a determination that the determined distance is less than the threshold, decrease the utilization setting of the second set of nozzles of the first printhead to decrease the amount of ink to be dispensed by the second set of nozzles.

20. The printer of claim 17, wherein the instructions are to cause the processor to:

determine whether the nozzles of the first printhead are aligned with the nozzles of the second printhead, and in response to a determination that the nozzles of the first printhead are misaligned with the nozzles of the second printhead, determine the distance between the last nozzle of the first printhead to be utilized at 100% and the last nozzle of the second printhead to be utilized at 100%.

* * * * *